United States Patent [19]

Liles et al.

[11] Patent Number: 4,701,289

[45] Date of Patent: Oct. 20, 1987

[54] METHOD AND APPARATUS FOR THE RAPID SOLIDIFICATION OF MOLTEN MATERIAL IN PARTICULATE FORM

[75] Inventors: Donald T. Liles; John L. Speier, both of Midland, Mich.

[73] Assignee: Dow Corning Corporation, Midland, Mich.

[21] Appl. No.: 796,369

[22] Filed: Nov. 8, 1985

[51] Int. Cl.[4] ..... B29B 9/10

[52] U.S. Cl. ..... 264/8; 425/8

[58] Field of Search ..... 264/8; 425/8, 10

[56] References Cited

U.S. PATENT DOCUMENTS

| | | | |
|---|---|---|---|
| 1,782,038 | 11/1930 | Haak | 425/8 |
| 2,020,719 | 11/1935 | Bottoms | 62/74 |
| 2,304,130 | 12/1942 | Truthe | 264/8 |
| 2,439,772 | 4/1948 | Gow | 425/8 |
| 2,752,196 | 6/1956 | Chisholm et al. | 239/224 |
| 3,659,428 | 5/1972 | Kunioka et al. | 62/64 |
| 4,053,264 | 10/1977 | King | 425/8 |
| 4,078,873 | 3/1978 | Holiday et al. | 425/8 |
| 4,347,199 | 8/1982 | Speier et al. | 264/8 |
| 4,375,375 | 3/1983 | Slaughter | 425/8 |
| 4,375,440 | 3/1983 | Thompson | 264/12 |
| 4,405,535 | 9/1983 | Norman et al. | 264/11 |
| 4,419,060 | 12/1983 | Speier et al. | 425/8 |

OTHER PUBLICATIONS

T. Yamaguchi et al., Appl. Phys. Letter., 33(5), 9--1-1978, pp. 468-470.

*Primary Examiner*—Jan H. Silbaugh
*Assistant Examiner*—Mary Lynn Fertig
*Attorney, Agent, or Firm*—Dennis H. Rainear

[57] ABSTRACT

Described are methods and apparati for the rapid solidification of molten materials into finely divided particulate form. Molten material is atomized by a centrifugal atomizer which includes a rotating member with vanes which accelerate and atomize the molten material. The mist of atomized molten material thus produced is introduced into a mist of atomized liquid coolant or a mist of finely divided volatile solid coolant or a mixture thereof. The heat of solidification of the mist of molten material is rapidly transferred to the mist of coolant whereby the molten material solidifies into fine particles.

2 Claims, 7 Drawing Figures

METHOD AND APPARATUS FOR THE RAPID SOLIDIFICATION OF MOLTEN MATERIAL IN PARTICULATE FORM

BACKGROUND OF THE INVENTION

The present invention relates to improvements in the rapid solidification of molten materials, including, but not limited to, metals, metalloids, and alloys.

For many applications, it is necessary that materials, including metals, metalloids, and alloys be provided in particulate form. Many systems have been devised for doing this. Among these are centrifugal atomizers which exist in various forms. In one form of centrifugal atomizers the material to be atomized is fed onto the surface of a rotating disc-like member which may be dished or flat. In one form of such systems a gas is used to cool the particles thrown off the rotating member by centrifugal forces. Representative of this type of system are U.S. Pat. Nos. 2,752,196, 4,053,264, and 4,078,873. Other systems rely on contact of molten droplets with a cooled surface.

In U.S. Pat. No. 4,347,199 granted Aug. 31, 1982 to Gentle and Speier, there is described a method and apparatus which provide a centrifugal atomizer making use of the heat of vaporization of liquid coolant and which thereby provides a system which offers rapid cooling of most components under equilibrium conditions at or near boiling point of the liquid coolant used. In U.S. Pat. No. 4,419,060, issued Dec. 6, 1983 to Liles and Speier a similar apparatus and method are taught, the primary difference being the location on the rotating disc at which the molten material is introduced. The solidified product produced by the apparati and methods of Gentle and Speier and Liles and Speier are, however, irregular and often flattened. This indicates that a major portion of the product produced by those methods is "splat cooled", i.e., the molten material cools and freezes while in contact with the rotating disc, builds up until its mass is such that it is thrown by centrifugal forces from the rotating device. This results in irregular particle shape and disproportionate particle size distribution.

Another splat cooling device is that described in U.S. Pat. No. 4,375,440, issued Mar. 1, 1983 to Thompson. In the apparatus described therein, molten metal is poured onto a spinning atomization disc means whereby liquid metal droplets leave the disc in a horizontal plane. An annular cooling gas jet flowing normal to the particle plane around the disc deflects the heavier liquid droplets to a conical splat plate which is fixed to rotate with said disc, whereby the droplets splat and cool, and are ejected by centrifugal force.

In U.S. Pat. No. 4,405,535, issued Sept. 20, 1983 to Raman et al., there is taught a method of preparing solid metal particles by contacting a molten stream of the material with a rapidly moving wall of a centrifugally disposed rotating liquid quench fluid, such as water or an oil, etc. In this manner, the stream of molten material is broken into molten globules or particles and rapidly quenched by the liquid. Raman et al. differs significantly from the instant invention by requiring the use of a liquid quenching fluid while the instant invention utilizes the more efficient atomized mist of coolant. In fact, Raman et al. is limited to liquid quenching fluids capable of being placed in the state of a rapidly moving centrifugally disposed rotating wall-like liquid mass and expressly teaches against atomization techniques.

Similarly, U.S. Pat. No. 2,439,772 issued on Apr. 13, 1948 to Gow, uses a revolving container containing a cooling or quenching liquid which from centrifugal force is forced into an annular vertical wall of revolving liquid into which are thrown globules of molten metal at a substantially normal horizontal path thereto to penetrate the liquid rather than glance off. See also U.S. Pat. No. 1,782,038, issued Nov. 18, 1930 to B. Haak, in which a melt of calcium nitrate salt was processed into globular bodies by centrifugation into a moving coolant bath of carbon tetrachloride.

In U.S. Pat. No. 4,078,873, issued Mar. 14, 1978 to Holiday et al., there is claimed an apparatus for producing metal particles by means of centrifugally throwing molten metal into an annular curtain of downwardly projecting cooling gas. In U.S. Pat. No. 4,377,375, issued Mar. 22, 1983 to Slaughter, there is taught a method and an apparatus for producing metal powders by rapid solidification of molten alloy. Slaughter atomizes molten alloy and centrifugally throws it into a stream of seed particles of solid material. The seed particles are impacted by the molten droplets causing the molten material to thinly deposit on the seed particles. Although this produces solidification, it has the disadvantage of producing larger particles due to the buildup on the seed particles.

T. Yamaguchi et al. (Appl. Phys Lett. 33(5), Sept. 1, 1978, p. 468–470) teaches preparation of amorphous powder by a water atomization technique in which molten alloy is introduced into the intersection of a pair of high velocity water jets.

The instant invention provides a method of solidification of molten material exhibiting greater efficiency of cooling, more uniformity of particle size and smaller resultant particles.

SUMMARY OF THE INVENTION

It is accordingly an object of the present invention to efficiently produce solid particles from molten materials. It is a further object of the present invention to produce a significantly higher proportion of smaller particles. It is yet a further object of this invention to achieve the smaller particle size and improved uniformity at a cooling rate which exhibits efficiency previously unattainable. It is still further an object of this invention to provide an apparatus for producing such small particles. An atomized mist of molten material is introduced into an atomized mist of volatile solid coolant or liquid coolant or a mixture thereof. The heat of solidification of the molten material is efficiently transferred to the mist of coolant.

BRIEF DESCRIPTION OF DRAWINGS

The invention will become better understood to those skilled in the art from a consideration of the following Description of Preferred Embodiments when read in connection with the accompanying drawings wherein.

Tables I and II show particle size distribution as a function of the speed of rotation of the rotatable disc member.

DESCRIPTION OF PREFERRED EMBODIMENTS

Figure 1:
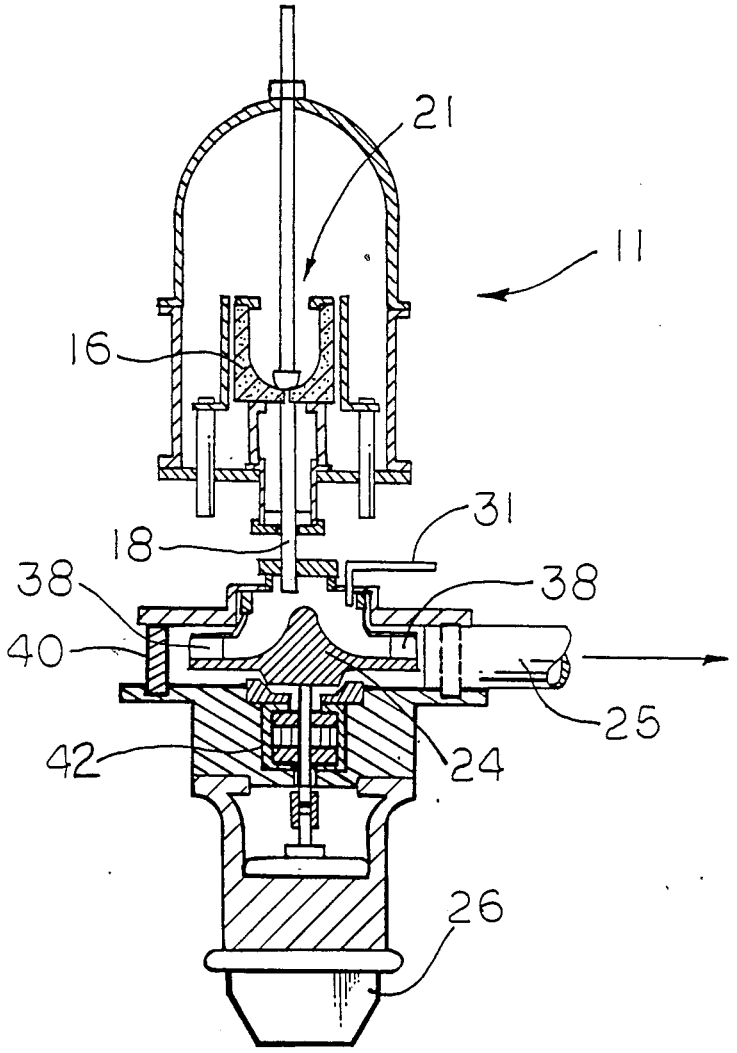
FIG. 1 is a diagrammatic view of a preferred embodiment of the invention.

Referring now to the drawings in FIG. 1 there is shown diagrammatically an apparatus for atomizing materials, including but not limited to, metals, metalloids, and alloys, in accordance with the present invention. At the top of the figure there is shown generally a heating means 11 for heating the material until it is molten. A crucible 16 is located within the heating means 11, said crucible being utilized to hold the melting and molten material prior to being released by means of valve 21 into a tube 18. Tube 18 conveys the molten material downward to a chamber in which is mounted horizontally a hump-backed disc-like rotor member 24 mounted for rotation by suitable means such as a variable speed motor 26 and a bearing assembly 42. The chamber is defined by a shroud 40 which acts as a safety device around the rotor member 24.

Coaxially mounted with respect to the center of rotation of the hump-backed disc-like rotor member 24 is the coolant supply means comprising a tube 31. In operation, a coolant is supplied by tube 31 to the atomized mist of molten material. Modified embodiments, as shown in FIGS. 4–7, provide for the addition of the molten material and the coolant at varying positions relative to each other. If desired, the coolant can be atomized in a separate atomizer and the mist of coolant thus produced introduced to the mist of molten material produced by the embodiment or vice versa.

The device has a plurality of vanes 38 positioned around the periphery of the disc-like rotor member 24 and protruding upwardly above its primary surface. Each such vane is positioned radially with respect to the center of rotation of the disc-like rotor member 24.

In operation of the system the vanes 38 accelerate the molten material to the velocity of the vanes 38 and atomize the molten material producing a mist of molten material, said mist being thrown from the outer most edge of the vanes 38 into the discharge tube 25 where the atomized mist becomes intimately mixed with an atomized mist of liquid coolant or volatile solid coolant or a mixture thereof.

DETAILED DESCRIPTION OF THE INVENTION

In accordance with these and other objects there are provided by the present invention centrifugal particulate-forming apparati demonstrating significant improvements over those described in U.S. Pat. Nos. 4,347,199, and 4,419,060. In the apparati of the instant invention, described infra, the molten material to be solidified and the coolant may both be, but need not be, atomized on the mechanical centrifugal atomizer. The molten material and the coolant may be introduced into the centrifugal atomizer as separate streams. The stream of molten material is introduced to the rotating disc member in such manner as to minimize solidification of the molten material by loss of heat by conduction into the surfaces of the atomizer.

The physical state of the coolant utilized in the instant invention is not limited to a mist of atomized liquid coolant but can include finely divided particles of volatile solids or combinations of atomized liquid coolants and finely divided volatile solid coolants. The essence of the invention is the rapid transfer of heat energy which results from the interaction of the atomized mist of the molten material and an atmosphere of finely divided coolant. The efficiency of the cooling process is directly related to the high degree of intimate mixing obtainable by the use of very finely divided materials. The extremely high surface areas which result from finely dividing both the molten material and the coolant, especially when the coolant is volatile and absorbs heat by vaporization, produces the rapid and efficient cooling capabilities of the instant invention.

In the apparati of the instant invention the coolant should be introduced into the atomizer at any point sufficiently far from the point of introduction of the molten material to minimize contact between the two materials until both have been separately atomized, so as to allow the separately atomized mists to become mixed when they enter the discharge tube. In the instant invention, almost all of the material apparently leaves the impeller before the rotor has made 1/6 of a revolution. When the rotor is turning at a rate of 10,000 rpm, the average residence time of molten material on the rotor is significantly less than one millisecond.

During the use of the device of the instant invention, there is a transfer of a small amount of heat from the molten material to the atomizer. This heat loss is an amount insufficient to produce solidification of the molten material but will result in heating of the atomizer. When the coolant and molten material are introduced into the same atomizer, there is obtained a beneficial value in cooling the atomizer. When cooling the atomizer is not necessary, however, for, example, when the melting point of the molten material is low, the coolant may be atomized by a separate device and a mist of atomized coolant may be introduced into the mist of atomized molten material.

Figure 2:
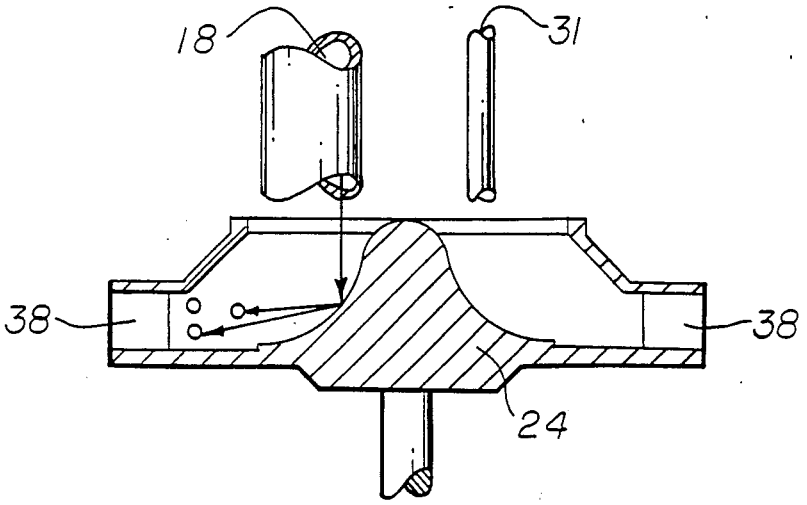
FIG. 2 is a cross-sectional view of a portion of the embodiment depicting the molten material tube, the coolant tube, the rotor, a vane, and the path of molten material.

FIG. 2 is a schematic diagram of one useful configuration of a cone shaped rotating disc and the entry ports for the molten material and the coolant, if the same device is to atomize both streams.

In FIG. 2, the molten material travels through the tube 18 and falls upon the inclined surface of the rotor cone 24 and bounces directly into the vanes 38. This differs significantly from the the disclosure in U.S. Pat. Nos. 4,347,199 and 4,419,060 wherein the the molten material contacts a film of coolant upon the rotating disc and is solidified on the rotor by the transfer of its heat of solidification to the film of coolant and then is centrifugally thrown from the disc-like member as a solid. The cone in the device depicted in FIG. 2 is a much higher and larger vertical member than that utilized in the prior art and has essentially no horizontal surface. This change in design reduces the residence time of the molten material because there are no horizontal surfaces for the molten material to traverse. The molten material does not wet the rapidly rotating inclined surface but rather bounces directly into the rotating vanes. The instant invention thus produces a marked increase in percentage of material that remains molten until leaving the vanes and is introduced into the atomized mist of coolant. A further result is a reduction in the percentage of irregularly shaped and large particles produced and an increase in the percentage of spherically shaped and small particles produced.

Figure 3:
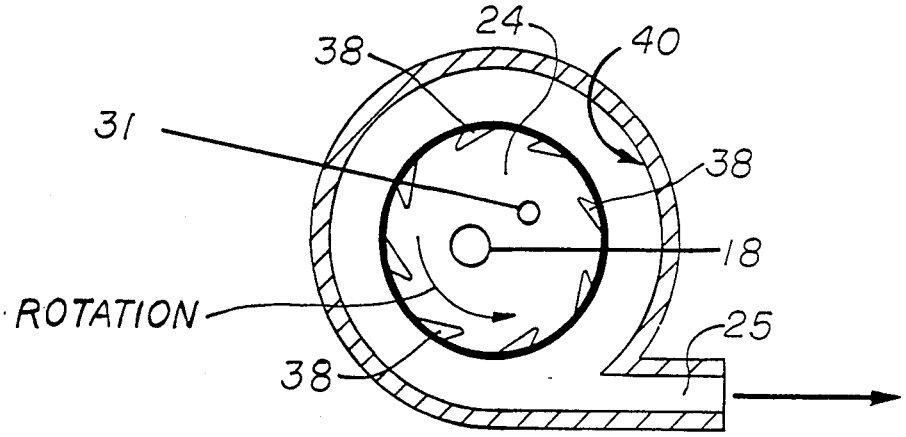
FIG. 3 is a diagrammatic view from above the rotor of the embodiment.

FIG. 3 shows relationship of the shroud 40 which surrounds the instant inventive device and the locations of the coolant and molten material feeds.

In FIG. 3, the coolant cools the vanes 38 and provides a dense atmosphere of atomized coolant. The extreme turbulence created by the rotating vanes 38 near the shroud 40 leads to very fast cooling rates by maximizing the interaction between the two atomized mists, one of coolant and one of molten material, which produces highly efficient cooling. This cooling produces solidification of the molten material into solid particles. Thus the solidification occurs in mixtures of the two mists and not on any surface of the device.

Figure 4:
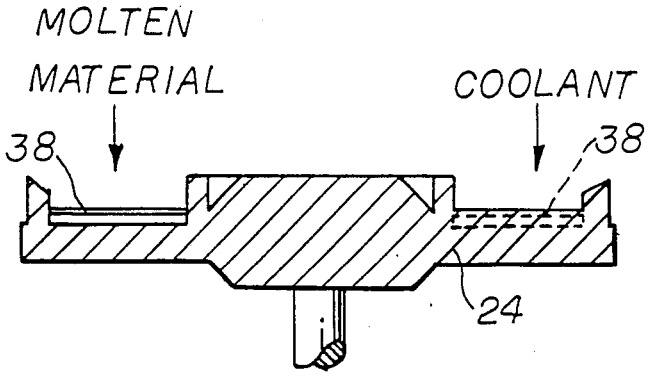
FIG. 4 is a cross-sectional view of a modified embodiment of the rotatable disc member.

A second configuration for an impeller of an atomizer of the instant invention is shown in FIG. 4.

Figure 5:
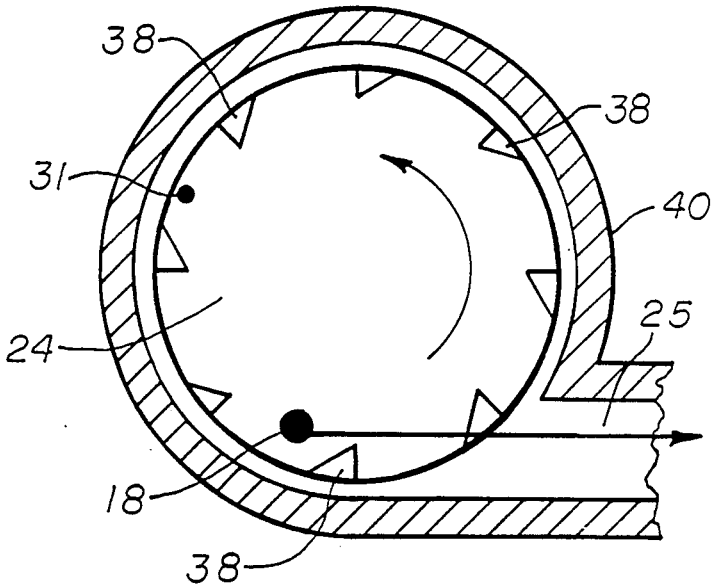
FIG. 5 is a diagrammatic view from above the rotor of the embodiment and depicts the relative points of introduction of the coolant and molten material.

In FIG. 4, the molten material is introduced directly upon the horizontal blade-like edges of short vanes 38 located on the periphery of the disc. Atomized material leaves the disc in a direction nearly tangential to the point of entry. This localized emission permits the shroud 40, enclosing the impeller, to be designed, as shown in FIG. 5, in such a way as to place the point of introduction of the molten material very close to the discharge tube.

In the apparati of FIGS. 2 through 5 both the molten material and the liquid coolant are atomized by the same centrifugal atomizer.

Figure 6:
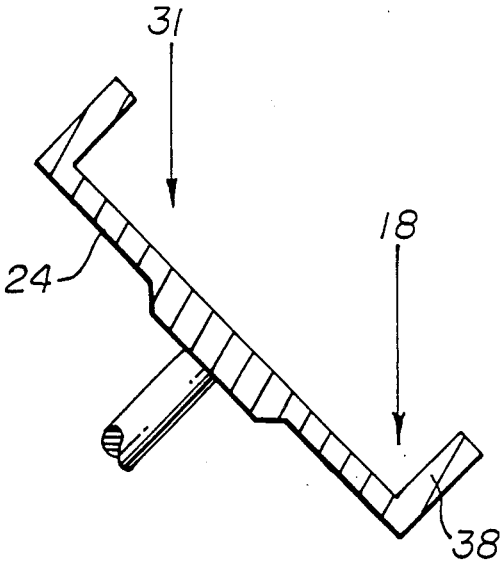
FIG. 6 is a cross-sectional view of a modified embodiment of the rotatable disc member.

Another form of an apparatus for the purpose of this invention has the configuration shown in FIG. 6, whereby the disc is placed at an angle to the horizontal plane of the shroud. The molten material is then introduced directly on the blade-like edges of the vanes 38 of the rotating disc, said vanes 38 being located on the periphery of the disc.

A further embodiment of the invention utilizes a turbine-like member wherein both the molten material and the coolant are introduced axially into the rotating turbine vanes and are intimately mixed upon leaving the turbine-like member axially rather than tangentially.

Figure 7:
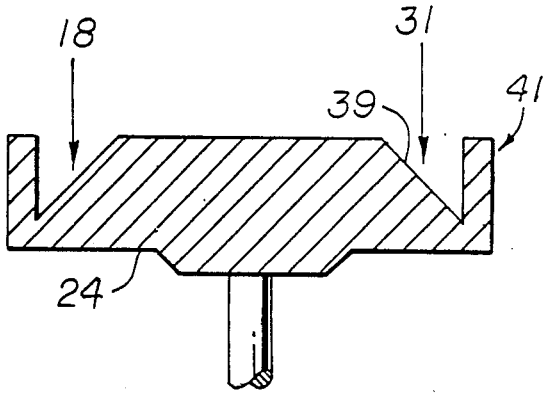
FIG. 7 is a cross-sectional view of a modified embodiment of the rotatable disc member.

Yet another configuration for an impeller of an atomizer for this invention has the form shown in FIG. 7, whereby the disc is maintained in a horizontal position but contains an angled rim or trough 39 adjacent to vertical vanes 41 located at the periphery of said disc. The molten material is added to the rotating disc at a point on the inclined or angled rim from which it bounces into the vanes 41. The molten material and the coolant can be, but need not be, introduced to the same device.

The coolant may either be atomized separately or introduced at another position on the same atomizer device in any of the above configurations in a manner whereby the atomized mist of coolant and the atomized mist of molten material can be intimately mixed after leaving the atomizer. These configurations of the instant invention result in a marked increase of cooling of the atomized particles in space rather than being splat cooled on a surface of the device. This is demonstrated by the extremely high percentage of spherical particles and very low incidence of large and/or irregularly shaped particles.

Now that those skilled in the art may better understand the instant invention, the following examples are provided. The examples are provided to further illustrate the nature of the invention which, however, is not limited thereto.

EXAMPLE 1

Using an impeller having the configuration shown in FIG. 7, Raney nickel, 50% Ni/50% Al, by weight, was heated to a temperature of 1450° C. and atomized at a rate of 400 grams in 64 seconds with the impeller turning at a rate of 5000 to 8000 revolutions per minute (rpm). Liquid water was added to the device at a rate of 1.8 liters/minute and thereby atomized into a mist of coolant. This method produced 220 grams, 60% yield, of particles that passed through a 325 mesh screen; 10% was 200–325 mesh; 10% 100–200 mesh; 6% 60–100 mesh; 7% 35–60 mesh and 7% larger than 35 mesh.

EXAMPLE 2

Under the same conditions used in Example 1, an alloy with the same composition as that used in Example 1 was atomized with a rotor speed of 10,000 to 11,000 rpm with a rate of coolant (hexane) addition of 1.8 liters/minute. This method produced 217 grams (61% yield) of particles which passed through a 325 mesh screen.

EXAMPLE 3

Metallurgical grade silicon, containing 4% copper and a mixture of trace amounts of brass and tin, was heated to a temperature of 1550° C., and atomized at a rate of 400 grams in 92 seconds in the apparatus containing the rotating disc shown in FIG. 7. The apparatus was rotating at 9000 to 10,000 rpm with water added, and the molten material was atomized, at a rate of 1.5 liter/minute. This method produced 217 grams (61% yield) of particles that passed through a 325 mesh screen; 10% 200–325 mesh; 13% 100–200 mesh; 6% 60–100 mesh; 5% 35–60 mesh and 5% larger than 35 mesh.

EXAMPLE 4

An alloy, 50% copper and 50% aluminum by weight, (1003.5 grams) at 1090° C. was atomized with an impeller of the configuration shown in FIG. 2 in 209 seconds. The rotor was turning at a rate of 12,000 rpm with 700 milliliters/minute of methanol added as the coolant. This alloy was heated to a temperature about 500° C. above its melting point. By this method, 911 grams of particulate product was produced, 98% of which passed through a 325 mesh screen. The mean particle size of this product was 12 microns with 15% of the product being less than 6 microns.

EXAMPLE 5

Pure copper, 1005.5 grams, at 1325° C. was atomized in the manner described in Example 5. The atomization was completed in 45 seconds with the rotor turning 14,000 rpm with 800 milliliters/minute of methanol introduced and atomized as the coolant. 52% of the particulate product thus obtained passed through a 325 mesh screen. The mean particle size of this product was 22 microns.

EXAMPLE 6

Metallurgical grade silicon (500 grams) containing 4% copper, 1% aluminum, and a trace amount of tin at 1575° C. was atomized in 115 seconds with a flow of 1.5 liters/minute of methanol as coolant. The experiment was done twice with all conditions held the same except that in the first case the rotor was turning 5000 rpm and in the second case the rotor was turning 10,000 rpm. The particle size distribution of the product thus obtained is shown in Table I. Table I illustrates that product particle size was a function of the speed of revolution of the rotor.

TABLE I

| METALLURGICAL GRADE SILICON | | | | | |
|---|---|---|---|---|---|
| | % Of Particles Smaller Than, Microns | | | | |
| | 44 μm | 75 μm | 150 μm | 250 μm | 425 μm |
| At 5,000 RPM | 53 | 62 | 78 | 82 | 85 |
| At 10,000 RPM | 83 | 85 | 87 | 90 | 93 |

EXAMPLE 7

Two samples of 303-stainless steel (503 grams and 803 grams) at 1550° C. were atomized in 52 seconds and 80 second, respectively. The coolant used was methanol under the same conditions employed in Example 7. The particle size distribution of the product thus obtained is shown in Table II.

TABLE II

| 303 STAINLESS STEEL | | | | | |
|---|---|---|---|---|---|
| | % Of Particles Smaller Than, Microns | | | | |
| | 44 μm | 75 μm | 150 μm | 250 μm | 425 μm |
| At 5,000 RPM | 25 | 35 | 45 | 52 | 57 |
| At 10,000 RPM | 40 | 51 | 65 | 70 | 80 |

EXAMPLE 8

A sample (500 grams) of semiconductor grade silicon that contained 2% copper, 1% aluminum, and a trace amount of tin at 1550° C. was atomized in 150 seconds with a rotor speed of 8000 rpm with 562 milliliters/minute of liquid ammonia as coolant. This method produced a powder (52% yield) which passed through a 200 mesh screen.

EXAMPLE 9

A sample (609 grams) of 304 stainless steel at 1560° C. was atomized in 90 seconds with a rotor speed of 12,000 rpm with 1,000 milliliters/minute of water as coolant to produce a powder (41% yield) that passed through a 325 mesh screen.

The powder produced in Example 9 was compacted in the Rapid Omnidirectional Compaction (ROC) process of the Kelsey-Hayes Company in Traverse City, Mich. The powder compacted to 98.9% of the theoretical density, was extremely hard and abrasion resistant.

EXAMPLE 10

A sample of iron alloy $Fe_{81.5}B_{14.5}Si_3Cl$ (492 grams) at 1600° C. was atomized in 180 seconds with 1.5 liters/minute of water as coolant to produce a powder, 36% of which passed through a 325 mesh screen.

The amorphous particles in this product, constituting approximately 10% of the total yield, were about 10 microns or smaller in size, and exhibited a diffraction pattern identical to that of a melt spun amorphous ribbon of the same material prepared as described in S. C. Huang, et al., Proc. Mat. Res. Soc. Annual Meeting, p. 211, 1981.

Larger particles produced were partially amorphous and partially crystalline.

That which is claimed is:

1. A method for solidification of molten material to particulate form, said method comprising atomization of molten materials to form a mist of finely divided molten material by expelling said molten material from the surface of a mechanical centrifugal atomizer into discharge tube, and introducing an atomized coolant or atomized mixture of coolants into the discharge tube, wherein the coolant or each coolant in a mixture of coolants has a boiling point below the temperature of solidification of the molten material and is a liquid at atmospheric temperature and pressure, and wherein an intimate mixture of said mist of atomized molten material and said atomized coolant or atomized mixture of coolants occurs off of the surface of the mechanical atomizer and in the space above said mechanical centrifugal atomizer or within the discharge tube, whereby the atomized mist of molten material is solidified and a particulate product is thereby formed.

2. A device for solidification of molten material to particulate form, said device comprising:

(A) a means of introducing a stream of molten material essentially directly onto the inclined surface of a cone shaped rotating disc with a plurality of vanes positioned radially with respect to the axis of rotation of said cone shaped rotating disc, wherein said cone shaped rotating disc has essentially no horizontal surface, whereby said molten material is expelled from said rotating disc to form an atomized mist of molten material;

(B) a discharge tube into which the atomized mist of molten material is expelled; and, (C) a means for introducing into the discharge tube an atomized mist of finely divided coolant or coolants, whereby the coolant is or the coolants are added off center of, and not directly to the apex of, the cone shaped rotating disc thereby cooling the atomized mist of molten material by the transfer of the heat of said atomized mist of molten material to the atomized mist of finely divided coolant, whereby the cooling atomized molten material solidifies.

* * * * *